US009411308B2

(12) United States Patent
Kubo

(10) Patent No.: US 9,411,308 B2
(45) Date of Patent: Aug. 9, 2016

(54) IMAGE FORMING APPARATUS

(71) Applicant: Sharp Kabushiki Kaisha, Osaka (JP)

(72) Inventor: Takashi Kubo, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 14/525,660

(22) Filed: Oct. 28, 2014

(65) Prior Publication Data

US 2015/0043938 A1 Feb. 12, 2015

Related U.S. Application Data

(63) Continuation of application No. 13/543,987, filed on Jul. 9, 2012, now Pat. No. 8,903,265.

(30) Foreign Application Priority Data

Aug. 26, 2011 (JP) ..... 2011-184586

(51) Int. Cl.
*G03G 15/20* (2006.01)
*G03G 21/20* (2006.01)

(52) U.S. Cl.
CPC ..... *G03G 21/206* (2013.01); *G03G 15/2028* (2013.01)

(58) Field of Classification Search
CPC ..... G03G 15/2017
See application file for complete search history.

(56) References Cited

U.S. PATENT DOCUMENTS

| | | | |
|---|---|---|---|
| 3,861,796 | A | 1/1975 | Tanaka et al. |
| 5,227,852 | A | 7/1993 | Smith et al. |
| 5,669,055 | A | 9/1997 | Thayer et al. |
| 2002/0164172 | A1 | 11/2002 | Tsubaki et al. |
| 2003/0115783 | A1 | 6/2003 | Woosley |
| 2005/0244203 | A1 | 11/2005 | Kamiyama |
| 2007/0019981 | A1 | 1/2007 | Kawamata |
| 2008/0044213 | A1 | 2/2008 | Kato et al. |
| 2008/0226325 | A1 | 9/2008 | Yamanaka et al. |
| 2009/0297233 | A1 | 12/2009 | Kameda |
| 2011/0176823 | A1 | 7/2011 | Kameda |

(Continued)

FOREIGN PATENT DOCUMENTS

| | | | | |
|---|---|---|---|---|
| JP | 08-036348 A | | 2/1996 | |
| JP | 08036348 A | * | 2/1996 | ..... G03G 21/20 |

(Continued)

OTHER PUBLICATIONS

Co-pending U.S. Appl. No. 13/543,987, filed Jul. 9, 2012 (current claims provided).

*Primary Examiner* — David Gray
*Assistant Examiner* — Sevan A Aydin
(74) *Attorney, Agent, or Firm* — Renner, Otto, Boisselle & Sklar, LLP

(57) ABSTRACT

The fixing apparatus is configured to include a fixing roller, a paper separation claw, a drive source that switches between a state in which the paper separation claw is in contact with the fixing roller and a state in which the paper separation claw is separated from the fixing roller, and a paper transport guide that is disposed on the downstream side of the fixing roller, the drive source including a heat generating element, and to further include a main ventilation channel that channels cooling air to a fixed paper sheet passing over the paper transport guide and a sub ventilation channel that is branched from the main ventilation channel and channels a portion of the cooling air to the heat generating element.

20 Claims, 8 Drawing Sheets

(56) References Cited

U.S. PATENT DOCUMENTS

| | | | | |
|---|---|---|---|---|
| 2011/0206409 | A1* | 8/2011 | Kondo et al. | 399/92 |
| 2013/0279953 | A1 | 10/2013 | Chikugo | |
| 2014/0161481 | A1 | 6/2014 | Udagawa | |

FOREIGN PATENT DOCUMENTS

| | | | |
|---|---|---|---|
| JP | 09-114158 | | 5/1997 |
| JP | 2000-047513 | A | 2/2000 |
| JP | 2001-005367 | | 1/2001 |
| JP | 2001-013808 | | 1/2001 |
| JP | 2001-228782 | | 8/2001 |
| JP | 2001-242738 | | 9/2001 |
| JP | 2001-255807 | | 9/2001 |
| JP | 2002-332140 | | 11/2002 |
| JP | 2003-241456 | | 8/2003 |
| JP | 2003-246490 | | 9/2003 |
| JP | 2004-279927 | | 10/2004 |
| JP | 2004-325614 | | 11/2004 |
| JP | 2005-316046 | | 11/2005 |
| JP | 2006-058695 | | 3/2006 |
| JP | 2006-349755 | | 12/2006 |
| JP | 2007-121348 | | 5/2007 |
| JP | 2007-121789 | | 5/2007 |
| JP | 2007-225780 | | 9/2007 |
| JP | 2008-225223 | | 9/2008 |
| JP | 2009-192998 | | 8/2009 |
| JP | 2009-288285 | | 12/2009 |
| JP | 2010-030749 | | 2/2010 |
| JP | 2010-230945 | | 10/2010 |

* cited by examiner

IMAGE FORMING APPARATUS

CROSS-REFERENCE TO RELATED APPLICATION

This application claims priority under 35 U.S.C. §119(a) on Patent Application No. 2011-184586 filed in Japan on Aug. 26, 2011, the entire contents of which are herein incorporated by reference.

BACKGROUND OF THE INVENTION

1. Field of the Invention

The present invention relates to fixing apparatuses that are mounted in image forming apparatuses and the like such as electrophotographic copiers, printers, facsimiles, and their complex machines, and specifically to fixing apparatuses provided with a cooling mechanism that cools fixed paper sheets on a paper transport guide.

2. Description of the Related Art

In image forming apparatuses such as copiers and printers, high-speed operation along with high-quality image formation have been sought, but a given amount of heat is needed in order to have toner fixed to paper sheets. Moreover, cooling of paper sheets after fixing is not sufficiently performed with high-speed operation, and thus a toner blocking phenomenon will occur in which toner on one paper sheet sticks to another paper sheet loaded on a discharge tray.

Moreover, in duplex printing, hot paper sheets of which one side has been fixed are transported again to a photosensitive drum. When this duplex printing is used often, a temperature increase of the photosensitive drum is caused, and the life of the photosensitive drum may be shortened and poor cleaning and the like may be caused.

Some image forming apparatuses of this kind cool paper sheets which have been heated at the time of fixing. A method for cooling paper sheets after fixing is disclosed in which air vents are provided in a paper transport guide and air flow is formed to cool output paper sheets (for example, JP 2006-349755A, JP 2009-192998A, and JP 2010-30749A).

Moreover, some image forming apparatuses are disclosed in which solenoids are provided in a fixing apparatus as a separation claw driving means that makes a paper separation claw come into contact with and separate from the surface of a fixing roller and a pressure roller in order to reliably prevent occurrence of paper clogging (jam) at a fixing portion when paper sheets are wound around the fixing roller and the pressure roller of the fixing apparatus (for example, JP 2008-225223A, JP 2001-242738A, and JP 2007-225780A).

The solenoid serving as a drive source for separation/contact operations of a paper separation claw is required to ensure stable and long-time separation/contact operations of the paper separation claw even if the solenoid is incorporated in the fixing apparatus and used in a high temperature environment. Moreover, since the solenoid itself is an electric component and serves as a heat generating source, the solenoid is required to be cooled appropriately.

However, since paper sheets that retain unfixed toner images pass through the fixing apparatus, it is difficult to employ a method in which cooling air generated by a cooling fan is guided into the fixing apparatus via a ventilation channel and is blown directly to the heat generating source to cool it. Therefore, conventionally, a method is often employed in which heat generated at heat generating sources such as the fixing apparatus and other components is sucked by suction fans provided on the apparatus casing of an image forming apparatus through a suction duct, and is discharged to the outside of the apparatus to cool each portion of the inside of the image forming apparatus.

SUMMARY OF THE INVENTION

The present invention has been achieved in view of the circumstances mentioned above, and it is an object to provide a fixing apparatus that can effectively perform cooling of the fixed paper sheets passing over the paper transport guide and a heat generating element (especially, solenoid) included in a drive source for driving the paper separation claw that is incorporated in the fixing apparatus to perform separation/contact operations without cooling air affecting paper sheets that retain unfixed toner images.

To solve problems above, the fixing apparatus of the present invention includes a fixing roller (a hot roller and a pressure roller), a paper separation claw, a drive source that switches between a state in which the paper separation claw is in contact with the fixing roller and a state in which the paper separation claw is separated from the fixing roller, and a paper transport guide that is disposed on the downstream side of the fixing roller, the drive source including a heat generating element, and further includes a main ventilation channel that channels cooling air to a fixed paper sheet passing over the paper transport guide and a sub ventilation channel that is branched from the main ventilation channel and channels a portion of the cooling air to the heat generating element. Here, it is preferable that the heat generating element is a solenoid.

According to a configuration mentioned above, it is possible to effectively perform cooling of the fixed paper sheets passing over the paper transport guide and the heat generating element (especially, solenoid) included in the drive source for driving the paper separation claw to perform separation/contact operations from/with the surface of the fixing roller without cooling air affecting paper sheets that retain unfixed toner images.

Moreover, in the present invention, it is preferable that the main ventilation channel is defined by a main duct and the sub ventilation channel is defined by a sub duct that is branched from the main duct. Since the main ventilation channel and the sub ventilation channel are configured to be defined by a main duct and a sub duct, it is possible to reliably channel air through the ventilation channels in the ducts without any air loss, and thus it is possible to effectively cool the fixed paper sheets and the heat generating element included in a drive source.

Also, in the present invention, it is preferable that the sub ventilation channel defined by the sub duct is configured to be formed in a tapered shape so as to be gradually narrowed from a branch portion of the main duct toward a leading end portion that faces the heat generating element. With this configuration, the occurrence of air accumulation in the sub duct can be prevented, and cooling air can be smoothly blown toward the heat generating element.

In addition, in the present invention, it is preferable that an air blowout port through which cooling air is blown to the heat generating element is provided in the leading end portion of the sub duct, and that the air blowout port is formed in a nozzle-shape in which the inner diameter on the branch portion side is larger and the inner diameter on the heat generating element side is smaller. With this configuration, air easily blows out from the inside of the sub ventilation channel, and it is possible to prevent hot air from flowing back from a space around the fixing roller in the fixing apparatus to the inside of the sub ventilation channel. Therefore, it is possible to effectively perform the cooling of the heat generating elements (especially, solenoids).

Moreover, in the present invention, it is preferable that a plurality of slits are provided in a casing portion of the heat generating element that faces the leading end portion so as to be arranged along the direction in which the cooling air that has passed through the sub duct flows. With this configuration, it is possible to guide cooling air in the sub ventilation channel into the casing portion due to slits provided in the casing portion of the heat generating elements (especially, solenoids), and thus it is possible to effectively perform cooling of the heat generating elements (especially, solenoids). Also, even if the amount of cooling air that is introduced into the casing portion through the sub duct is small, since the heat generating elements (especially, solenoids) are effectively cooled, it is possible to prevent excess cooling and thermal loss of the fixing apparatus from occurring and to maintain the temperature in the fixing apparatus appropriately.

In addition, in the present invention, the fixing apparatus may be configured to further include a heat insulating member that is disposed between the leading end portion of the sub duct and the casing portion that faces the leading end portion. With this configuration, heat generated by the fixing rollers in the fixing apparatus can be prevented from transferring directly to the sub duct by the heat insulating member, and thus a temperature increase in the sub duct is suppressed. As a result, cooling of the heat generating elements (especially, solenoids) can be further effectively performed.

Also, in the present invention, it is preferable that the main duct includes a ventilation opening, and that the ventilation opening is disposed on the lower face side opposite to the paper support face of the paper transport guide and projects toward the paper transport guide, and that a plurality of air vents in a slit-like shape are formed in the paper transport guide, and that a leading end opening portion of the ventilation opening is configured to be disposed so as to be in communication with a plurality of air vents in a slit-like shape. With this configuration, it is possible to effectively perform cooling of the fixed paper sheets passing over the paper transport guide and the heat generating elements (especially, solenoids) for driving the paper separation claw to perform separation/contact operations without cooling air affecting paper sheets that retain unfixed toner images.

Moreover, the fixing apparatus of the present invention may be configured to further include a heat insulating member that is disposed between the leading end of the ventilation opening and the paper transport guide. With this configuration, heat received by the paper sheet at the time of passing through the paper transport guide immediately after fixing can be prevented from transferring directly to the main duct by the heat insulating member, and thus a temperature increase in the main duct is effectively suppressed. As a result, cooling of the fixed paper sheet passing over the paper transport guide can be further effectively performed.

In addition, by using the present invention, an image forming apparatus can be realized that is configured to include an image forming portion that forms toner images on paper sheets and a fixing apparatus having any one of the above described configurations that fixes toner images formed on paper sheets. With this configuration, it is possible to provide an image forming apparatus that can effectively perform cooling of the fixed paper sheets passing over the paper transport guide and the heat generating element included in the drive source for driving the paper separation claw to perform separation/contact operations from/with the surface of the fixing roller without cooling air affecting paper sheets that retain unfixed toner images.

DESCRIPTION OF THE PREFERRED EMBODIMENT

Hereinafter, an embodiment of the present invention will be described with reference to the drawings.

Description of Overall Configuration of Image Forming Apparatus

In the present embodiment, an example is described in which a fixing apparatus according to one embodiment of the present invention is mounted in an electrophotographic copier (hereinafter, simply referred to as "copier") as one embodiment of an image forming apparatus.

Figure 1:
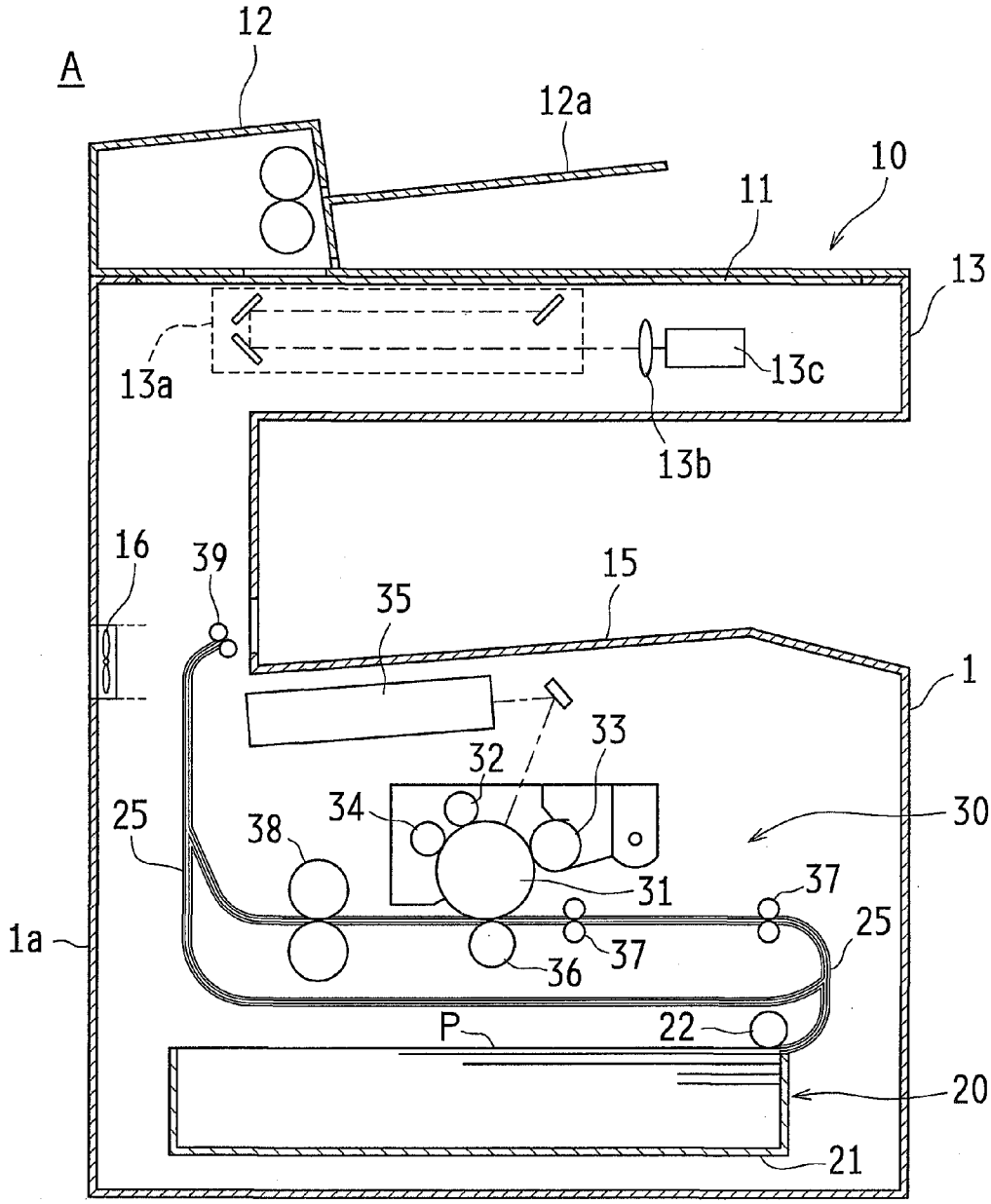
FIG. 1 is schematic view showing an overall configuration of an electrophotographic copier as one embodiment of image forming apparatuses in which a fixing apparatus according to one embodiment of the present invention is mounted.

In FIG. 1, a copier A is a copier that forms multicolored or monochrome images on a prescribed paper sheet (recording paper) according to image data transmitted from outside or image data obtained by reading originals. However, in the present embodiment, a copier that forms monochrome images is described as an example.

This copier A includes an original processing apparatus 10, a paper feed portion 20, an image forming portion 30, and a discharge portion 15.

The original processing apparatus 10 includes an original placement stage 11, an original transport apparatus 12, and an original reading portion 13 in an apparatus casing 1.

The original placement stage 11 is made of transparent glass, and originals can be placed thereon. The original transport apparatus 12 transports originals page by page that are stacked on an original tray 12*a*. The original transport apparatus 12 is configured to be able to pivot rearward in the direction perpendicular to the paper plane in FIG. 1, and originals can be placed on the original placement stage 11 by opening above the original placement stage 11. The original reading portion 13 can read originals that are being transported with the original transport apparatus 12 or are placed on the original placement stage 11, and includes a mirror group 13*a*, a condensing lens 13*b*, and an imaging element (CCD) 13*c*.

The paper feed portion 20 includes a paper feed cassette 21 and a pickup roller 22. The pickup roller 22 is provided near an end portion of the paper feed cassette 21, and picks up a paper sheet (recording paper) P from the paper feed cassette 21 page by page to feed the paper sheet to a paper transport path 25.

The image forming portion 30 includes a photosensitive drum 31, a charger 32, a development unit 33, a cleaner portion 34, an exposing unit 35, a transfer roller 36, and a fixing apparatus 38 and the like.

The image forming portion 30 is an electrophotographic image forming apparatus, and the photosensitive drum 31 whose surface is uniformly charged by bias application to the charger 32 is irradiated with a laser beam from the exposing unit 35 based on image data transmitted from the outside of the copier A or image data generated by reading originals to form an electrostatic latent image. This electrostatic latent image undergoes toner development in the development unit 33 to form a visual image (toner image). Moreover, the pickup roller 22 picks up the paper sheet P loaded on the paper feed cassette 21 that is installed in the lower portion of the apparatus casing 1 in synchronization with toner image formation, and a transport roller 37 transports the paper sheet P to a nip portion between the photosensitive drum 31 and the transfer roller 36. Then, a toner image on the photosensitive drum 31 is transferred to the paper sheet P by bias application to the transfer roller 36 and thus an image is formed on the paper sheet P. The paper sheet P to which the toner image is transferred is transported to the fixing apparatus 38, and the toner image is fixed by applying heat and pressure in the fixing apparatus 38, and then the paper sheet P is discharged onto the discharge portion 15 by a discharge roller 39.

It should be noted that an suction fan 16 is provided on a back face la side of the apparatus casing 1 in order to suck heat generated mainly in the image forming portion 30 and to discharge the heat outside the copier, and that an suction duct (not shown in FIG. 1) is provided in this suction fan 16 in order to effectively suck heat generated from the components in the apparatus casing 1.

Description of Fixing Apparatus

Figure 2:
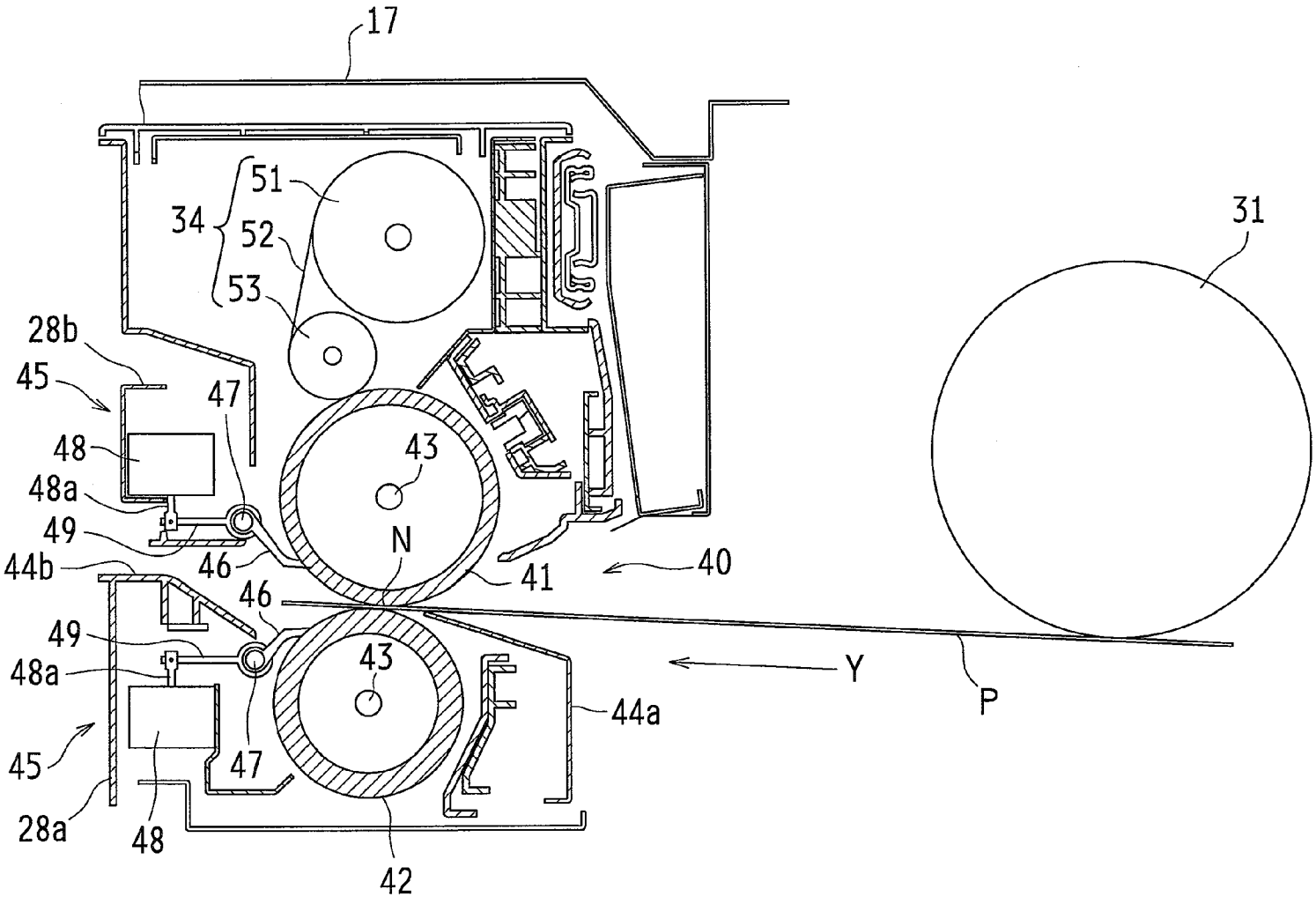
FIG. 2 is a schematic cross-sectional view showing a peripheral structure of a fixing apparatus.
Figure 3:
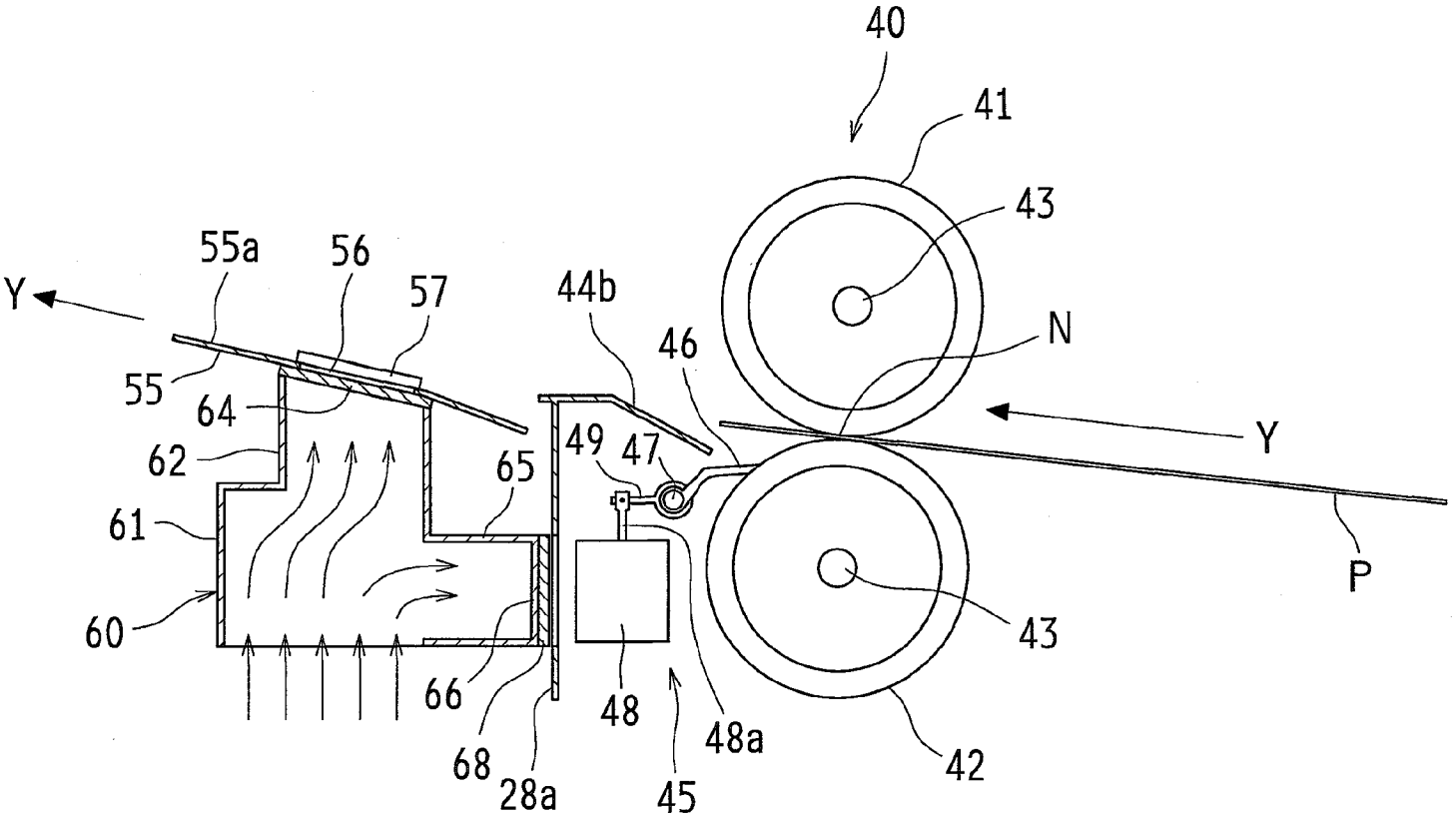
FIG. 3 is a schematic cross-sectional view showing schematically a peripheral structure of a fixing apparatus that includes a cooling duct portion, which is a feature of one embodiment of the present invention.
Figure 4:
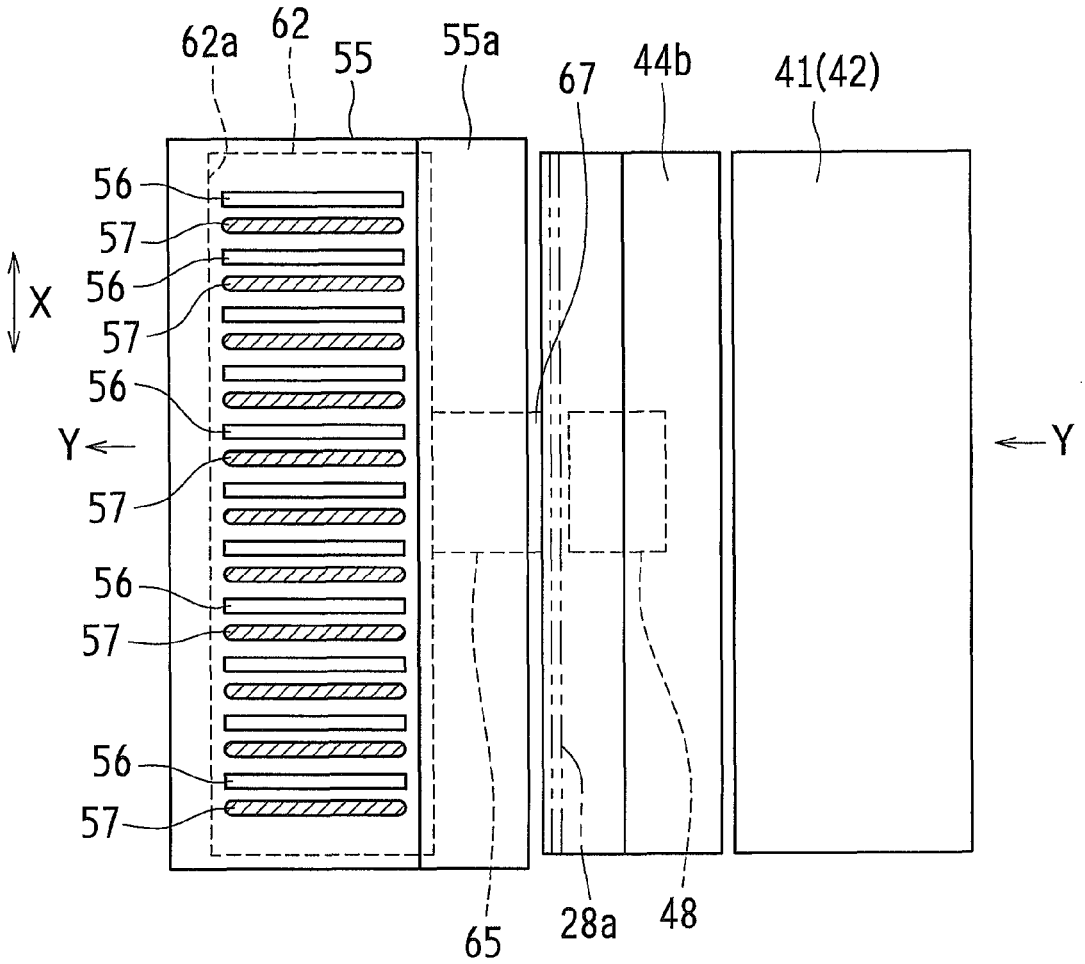
FIG. 4 is a plan view showing a main portion of a fixing apparatus that includes a cooling duct portion, which is a feature of one embodiment of the present invention.
Figure 5A:
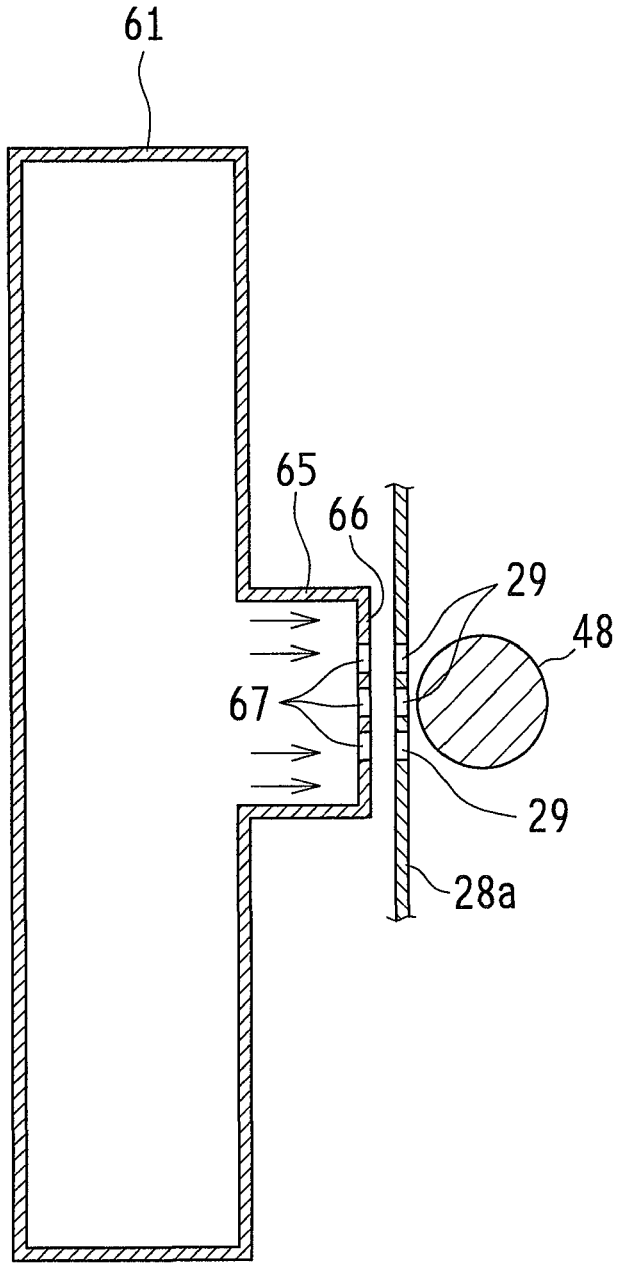
FIG. 5A is a schematic transverse cross-sectional view of a cooling duct portion, which is a feature of one embodiment of the present invention is viewed from above.
Figure 5B:
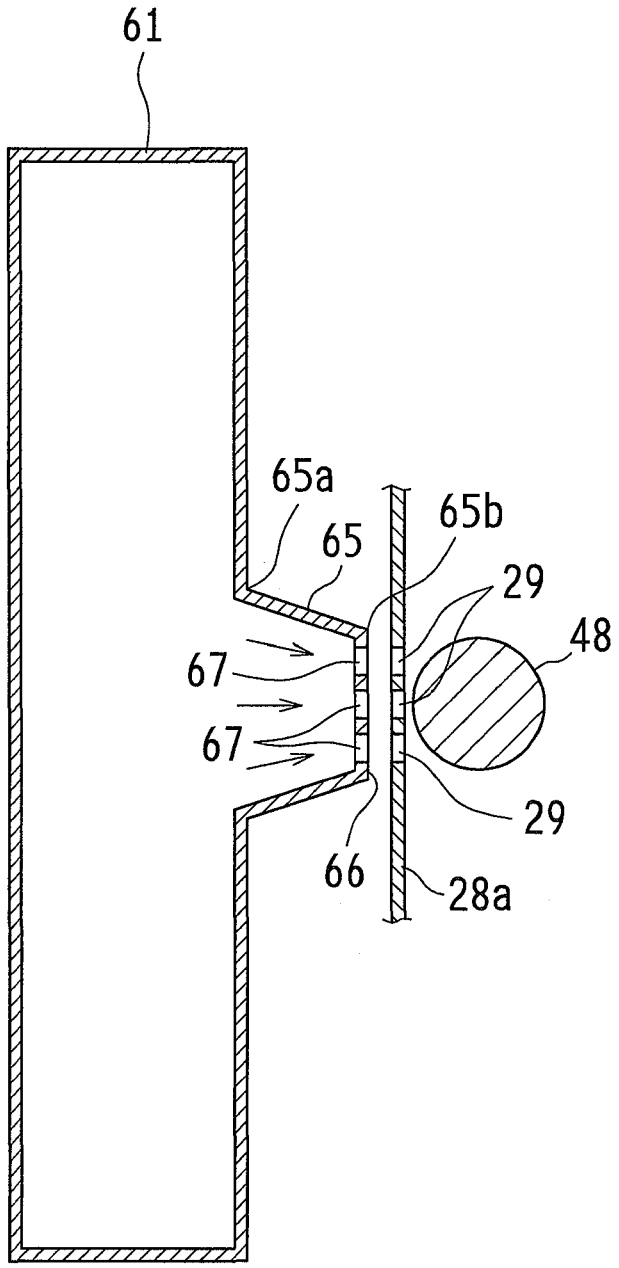
FIG. 5B is a schematic transverse cross-sectional view of a cooling duct portion, which is a feature of one embodiment of the present invention is viewed from above.
Figure 5C:
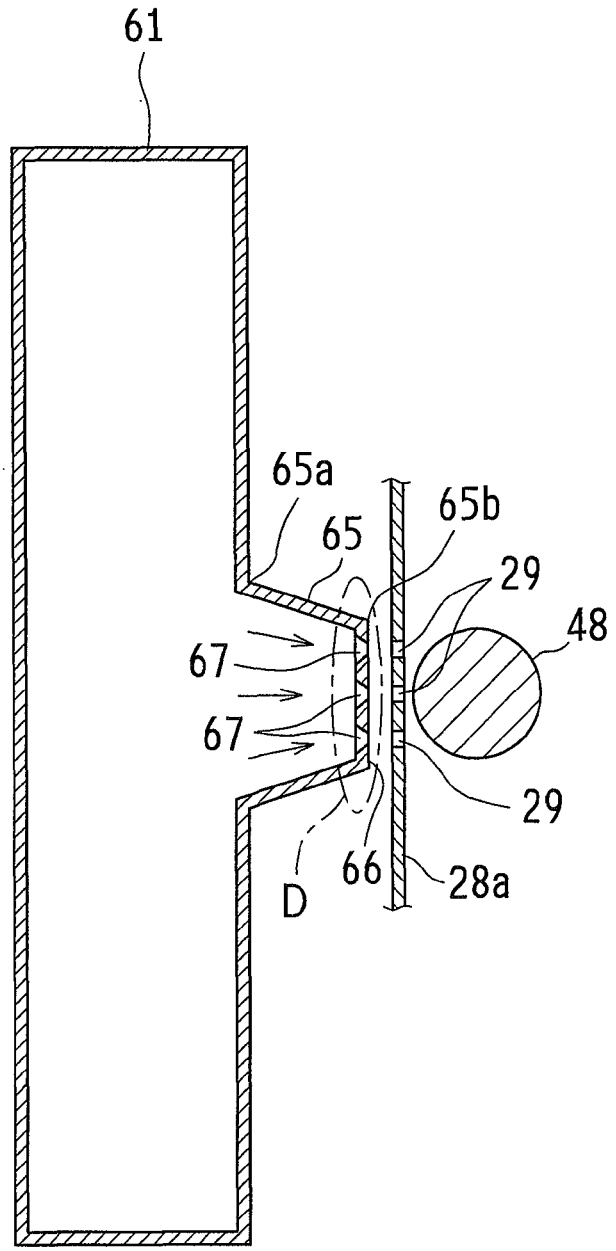
FIG. 5C is a schematic transverse cross-sectional view of a cooling duct portion, which is a feature of one embodiment of the present invention is viewed from above.

Arrow signs Y in FIGS. 2 through 4 show a paper transport direction. Moreover, arrows in FIGS. 5A~5C show the flow of air (cooling air).

The fixing apparatus 38 includes a fixing portion 40 configured with a roller pair consisting of an upper heat roller (hot roller) 41 and a lower heat roller (pressure roller) 42. The upper heat roller 41 and the lower heat roller 42 are fixing rollers in each of which a heat generating element 43 such as a heater is provided and by which unfixed toner on the paper sheet P is molten by heating. While the paper sheet P is transported in a sandwiched manner by this roller pair, heat and pressure are applied to the paper sheet P, and thus unfixed tonner images that are transferred to the paper sheet P can be fixed.

A pre-fixing paper guide 44*a* is provided on the upstream side (upstream side in the paper transport direction; the photosensitive drum 31 side) of the fixing portion 40 in order to guide the paper sheet P from the photosensitive drum 31 to the nip portion N where the hot roller 41 is pressed against the pressure roller 42. A fixing exit guide 44*b* is provided on the downstream side (downstream side in the paper transport direction) of the fixing portion 40 in order to guide the paper sheet P on which a toner image is fixed toward the discharge portion 15.

Moreover, for each of the hot roller 41 and the pressure roller 42, a separation claw unit 45 is provided on the downstream side of the nip portion N. These separation claw units 45 mainly include respective paper separation claws 46 that are movable paper separation claws which selectively come into contact with or separate from the peripheral surface of the hot roller 41 and the pressure roller 42, respective drive shafts 47 that axially support the paper separation claws 46, and respective solenoids 48 that serve as drive sources to drive respective drive shafts 47. The solenoids 48 switch between a state in which the paper separation claws 46 are in contact with the hot roller 41 and the pressure roller 42 and a state in which the paper separation claws 46 are separated from the hot roller 41 and the pressure roller 42. Each paper separation claw 46 is axially supported by the corresponding drive shaft 47 via a spring (not shown). An arm 49 is attached to one end portion of each drive shaft 47. A plunger 48*a* of each solenoid 48 is axially supported by the corresponding arm 49.

The separation claw unit 45 provided for the pressure roller 42 is disposed below the fixing exit guide 44*b*, and the solenoid 48 is disposed so as to be adjacent to a lower partition plate 28*a* that extends vertically downward from the end portion on the downstream side of the fixing exit guide 44*b*. In other words, the separation claw unit 45 is disposed in the fixing apparatus 38 so as to be contained within a casing portion defined by the fixing exit guide 44*b* and the lower partition plate 28*a*.

Meanwhile, the separation claw unit 45 provided for the hot roller 41 is disposed above the fixing exit guide 44*b* and is disposed in the fixing apparatus 38 so as to be contained within an upper side partition plate 28*b* (the casing portion) formed in a squared U-shape.

Moreover, the cleaner portion 34 that includes a take-out roll 51, a web roll 52 that is wound around the take-out roll 51, and a take-up roll 53 that takes up the web roll 52 which has been wound off is provided in the hot roller 41. Also, although not shown in the drawings, for example, a cleaning pad or the like serving as a cleaning means is provided in the pressure roller 42.

Meanwhile, as shown in FIGS. 3 and 4, a paper transport guide 55 is provided on the further downstream side of the fixing exit guide 44*b* so as to transport the paper sheet P on which fixing has been completed.

The paper transport guide 55 is a lower transport guide serving as a guide member that supports the paper sheet P transported after the toner images are fixed on the paper sheet P. A plurality of air vents 56 in a slit-like shape passing through a paper support face 55*a* are provided in the paper transport guide 55 so as to be lined up in the width direction X that is perpendicular to the paper transport direction Y.

Moreover, a plurality of guide ribs 57 are provided in the paper support face 55*a* so as to be lined up in the width direction X in order to lower sliding friction by reducing the contact area between the paper transport guide 55 and the paper sheet P. The air vents 56 and the guide ribs 57 are disposed alternately in the width direction X. Also, the air vents 56 and the guide ribs 57 are arranged such that the dimensions of the air vents 56 and the guide ribs 57 along the paper transport direction Y are longer than along the width direction X.

A cooling duct 60 that is formed as a separate body from the paper transport guide 55 is provided on the lower face side opposite to the paper support face 55*a* of the paper transport guide 55. The purpose of arranging this cooling duct 60 is to allow air to flow in order to cool the paper sheet P that is heated in the fixing portion 40 and is transported on the paper transport guide 55. The cooling duct 60 includes a main duct 61 that is a main ventilation channel to channel cooling air to the fixed paper sheet P passing over the paper transport guide 55 and a sub duct 65 that is a branch of the main duct 61 and is a sub ventilation channel to channel a portion of the cooling air to the solenoid (heat generating element) 48 serving as the drive source of the separation claw unit 45 on the side of the pressure roller 42. With this configuration, without cooling air affecting the paper sheet P that retains an unfixed toner image, it is possible to effectively cool the fixed paper sheet P passing over the paper transport guide 55 and to effectively cool the solenoid 48 serving as the drive source for driving the paper separation claw 46 to perform separation/contact operations.

The upper portion of the main duct 61 serves as a ventilation opening 62 whose shape is one step narrower than the other portion so as to face the air vents 56 provided in the paper transport guide 55. A leading end opening portion (i.e., leading end opening portion that faces the air vents 56 of the paper transport guide 55) 62*a* of the ventilation opening 62 is disposed so as to be in communication with the plurality of air vents 56 formed in the paper transport guide 55. Moreover, the ventilation opening 62 is disposed so as not to project into the paper transport path side (i.e., above the paper support face 55*a*) of the paper support face 55*a* of the paper transport guide 55. Therefore, the ventilation opening 62 does not come into contact with the paper sheet P that is transported on the paper transport guide 55.

Air is sent from a cooling fan (not shown) to the cooling duct 60 having this configuration, and the air can be directly blown against paper sheets.

The suction fan 16 provided on the back face la of the apparatus casing 1 may be used as the cooling fan, or the cooling fan may be provided separately from the suction fan 16. With this, the paper sheet heated in the fixing portion 40 is cooled.

When the paper sheet P is being transported, the cooling air directly hits the paper sheet P, and heat from the paper sheet P flows to the paper support face 55*a* of the paper transport guide 55. Since the air at this time holds the heat of the paper sheet P and then is diffused, the paper transport guide 55 receives the heat hold by the paper sheet P after the fixing and is warmed.

Note that it is preferable that the paper transport guide 55 and the main duct 61 are formed as separate bodies so as not to be in contact with each other. Moreover, it is preferable that a heat insulating member 64 is disposed as a structure support body between the paper transport guide 55 and the main duct 61. As the heat insulating member 64, ceramics and non-woven fabrics and the like may be used. Arrangement of the heat insulating member 64 can prevent the heat received by the paper sheet P at the time of passing through the paper transport guide 55 immediately after fixing from transferring directly to the cooling duct 60 side, and thus a temperature increase in the cooling duct 60 is suppressed. It should be noted that the height of the guide ribs 57 may be heightened in order to increase the strength of the paper transport guide 55.

Meanwhile, the sub duct 65 branched from the main duct 61, as shown in FIGS. 3 and 5A, may be in a shape of a simple cylinder or a simple quadrangular cylinder, or as shown in FIGS. 5B and 5C, may be preferably formed in a tapered shape so as to be gradually narrowed from a branch portion 65*a* of the main duct 61 toward a leading end portion 65*b* that faces the solenoid 48 serving as the heat generating element. By forming the sub duct 65 in the tapered shape as above, the occurrence of air accumulation in the sub duct 65 can be prevented, and cooling air can be smoothly blown toward the solenoid 48.

Figure 5D:
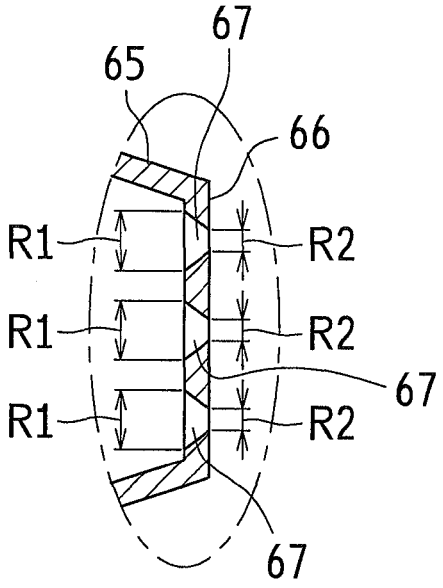
FIG. 5D is a cross-sectional view showing an enlarged D portion of FIG. 5C.

Moreover, an air blowout port 67 is provided in an end face 66 of the leading end portion 65*b* side of the sub duct 65 in order to blow cooling air toward the solenoid 48. This air blowout port 67, as shown in FIGS. 5A and 5B, may be in a shape of a simple cylinder, or as shown in FIGS. 5C and 5D, may be preferably formed in a nozzle-shape so that an inner diameter R1 of the branch portion 65*a* side (an interior of the leading end portion) is larger and an inner diameter R2 of the solenoid 48 side (an exterior of the leading end portion) is smaller (R1>R2). Since the air blowout port 67 is formed in the nuzzled-shape as above in which the inner diameter of the branch portion 65*a* side (interior) is larger and the inner diameter of the solenoid 48 side (exterior) is smaller, air easily blows out from the inside of the sub duct 65 and it is possible to prevent hot air from flowing back from a space around the fixing portion 40 in the fixing apparatus to the inside of the sub duct 65. Therefore, it is possible to perform cooling of the solenoid 48.

Moreover, a plurality of slits 29 are provided in a lower partition plate 28*a* that faces the end face 66 of the sub duct 65 so as to be arranged along the direction in which the cooling air that has passed through the sub duct 65 flows. By also arranging the slits 29 in the lower partition plate 28*a* as above, it is possible to guide cooling air in the sub duct 65 from the slits 29 of the lower partition plate 28*a* into the casing portion, and thus it is possible to directly cool the solenoid 48. Also, even if the amount of cooling air that is introduced into the casing portion through the sub duct 65 is small, it is possible to prevent excess cooling and thermal loss of the fixing apparatus from occurring because the solenoid 48 is effectively cooled. Therefore, the temperature in the fixing apparatus can be kept appropriately.

Moreover, as shown in FIG. 3, it is preferable that a heat insulating member 68 is disposed as the structure support body between the end face 66 of the sub duct 65 and the lower partition plate 28*a* that faces the end face 66. As the heat insulating member 68, ceramics and non-woven fabrics and the like may be used in a similar manner to the above. Arrangement of the heat insulating member 68 can prevent the heat generated in the fixing portion 40 in the fixing apparatus from transferring directly to the sub duct 65, and thus a temperature increase in the sub duct 65 is suppressed. It should be noted that the sub duct 65 branched from the main duct 61 may be formed as a single body integrating with the main duct 61, or formed as a separate body from the main duct 61.

In the present embodiment, the cooling duct 60 is only disposed below the paper transport guide 55 and is not disposed above the paper transport guide 55. In other words, the cooling unit 60 is configured to be unable to directly cool the solenoid 48 of the upper separation claw unit 45 with which the hot roller 41 is provided. This is because it is not necessary to arrange the cooling duct 60 on the upper separation claw unit 45 since the heat generated from the solenoid 48 of the upper separation claw unit 45 rises up and thus effects of the heat on the surface side of the paper transport guide 55 are relatively small. Moreover, as mentioned above, the suction fan 16 is provided on the back face la side of the apparatus casing 1 in order to suck air in the copier and to discharge air outside the copier. An suction duct 17 (see FIG. 2) that is in communication with the suction fan 16 is disposed above the hot roller 41, more specifically, above the cleaner portion 34. Therefore, heat generated from the solenoid 48 of the upper separation claw unit 45 is discharged outside of the copier through the suction duct 17, and thus without arranging the cooling duct 60 above the paper transport guide 55, the solenoid 48 of the upper separation claw unit 45 is cooled sufficiently. However, quite naturally, the cooling duct 60 may be configured to be disposed above the paper transport guide 55 so that the solenoid 48 of the upper separation claw unit 45 is also cooled by the cooling duct 60.

The present invention may be embodied in various other forms without departing from the spirit or essential characteristics thereof. The embodiments disclosed in this application are to be considered in all respects as illustrative and not limiting. The scope of the invention is indicated by the appended claims rather than by the foregoing description, and all modifications or changes that come within the meaning and range of equivalency of the claims are intended to be embraced therein.

What is claimed is:

1. An image forming apparatus comprising a fixing portion having an electric component, and a paper transport guide, wherein the paper transport guide comprises a plurality of guide ribs provided on a part of a paper support face to protrude from the paper support face and a plurality of air vent slits having one side longer than another side passing through the paper support face, the electric component is provided on a side of a face opposite to the paper support face of the paper transport guide, the image forming apparatus further comprises a ventilation channel that channels cooling air to a fixed paper sheet passing over the paper transport guide and to the electric component, the ventilation channel is disposed on the side of the face opposite to the paper support face of the paper transport guide, and the cooling air is supplied to the ventilation channel.

2. The image forming apparatus according to claim 1, wherein the ventilation channel is defined by a first ventilation channel and a second ventilation channel, and the second ventilation channel is branched from the first ventilation channel.

3. The image forming apparatus according to claim 2, wherein the first ventilation channel includes a ventilation opening which is disposed on a lower face side opposite to the paper support face of the paper transport guide and which projects toward the paper transport guide, and a leading end opening portion of the ventilation opening is disposed so as to be in communication with a plurality of air vents which are formed in the paper transport guide.

4. The image forming apparatus according to claim 3, further comprising a heat insulating member that is disposed between the leading end opening portion of the ventilation opening and the paper transport guide.

5. The image forming apparatus according to claim 2, wherein the second ventilation channel is formed in a tapered shape so as to be gradually narrowed from a branch portion of the first ventilation channel toward a leading end portion that faces the electric component.

6. The image forming apparatus according to claim 5, wherein an air blowout port through which cooling air is blown to the electric component is provided in the leading end portion of the second ventilation channel, and the air blowout port is formed in a nozzle-shape in which an inner diameter on an interior of the leading end portion is larger and an inner diameter on an exterior of the leading end portion is smaller.

7. The image forming apparatus according to claim 1, wherein the electric component is a drive source which drives separation means for separating transported paper.

8. The image forming apparatus according to claim 7, wherein the separation means is a separation claw which comes into contact with or separates from a fixing roller.

9. The image forming apparatus according to claim 7, wherein the ventilation channel is defined by a first ventilation channel and a second ventilation channel, and the second ventilation channel is branched from the first ventilation channel.

10. The image forming apparatus according to claim 9, wherein the second ventilation channel is formed in a tapered shape so as to be gradually narrowed from a branch portion of the first ventilation channel toward a leading end portion that faces the electric component.

11. The image forming apparatus according to claim 8, wherein the ventilation channel is defined by a first ventilation channel and a second ventilation channel, and the second ventilation channel is branched from the first ventilation channel.

12. The image forming apparatus according to claim 11, wherein the second ventilation channel is formed in a tapered shape so as to be gradually narrowed from a branch portion of the first ventilation channel toward a leading end portion that faces the electric component.

13. The image forming apparatus according to claim 11, wherein an air blowout port through which cooling air is blown to the electric component is provided in the leading end portion of the second ventilation channel, and the air blowout port is formed in a nozzle-shape in which an inner diameter on an interior of the leading end portion is larger and an inner diameter on an exterior of the leading end portion is smaller.

14. The image forming apparatus according to claim 12, wherein an air blowout port through which cooling air is blown to the electric component is provided in the leading end portion of the second ventilation channel, and the air blowout port is formed in a nozzle-shape in which an inner diameter on an interior of the leading end portion is larger and an inner diameter on an exterior of the leading end portion is smaller.

15. An image forming apparatus comprising a fixing portion having an electric component, and a paper transport guide, wherein the paper transport guide comprises a plurality of guide ribs provided in a paper support face and a plurality of air vents, the electric component is provided on a side of a face opposite to the paper support face of the paper transport guide, the image forming apparatus further comprises a ventilation channel that channels cooling air to a fixed paper sheet passing over the paper transport guide and to the electric component, the ventilation channel is disposed on the side of the face opposite to the paper support face of the paper transport guide, the cooling air is supplied to the ventilation channel, the ventilation channel is defined by a first ventilation channel and a second ventilation channel, the second ventilation channel is branched from the first ventilation channel, the second ventilation channel is formed in a tapered shape so as to be gradually narrowed from a branch portion of the first ventilation channel toward a leading end portion that faces the electric component, and a plurality of slits are provided in a casing portion of the electric component that faces the leading end portion, the slits being arranged along a direction in which cooling air that has passed through the second ventilation channel flows.

16. The image forming apparatus according to claim 15, wherein the electric component is a drive source which drives separation means for separating transported paper.

17. The image forming apparatus according to claim 16, wherein the separation means is a separation claw which comes into contact with or separates from a fixing roller.

18. The image forming apparatus according to claim 17, further comprising a heat insulating member that is disposed between the leading end portion of the second ventilation channel and the casing portion that faces the leading end portion.

19. The image forming apparatus according to claim 16, further comprising a heat insulating member that is disposed between the leading end portion of the second ventilation channel and the casing portion that faces the leading end portion.

20. The image forming apparatus according to claim 15, further comprising a heat insulating member that is disposed between the leading end portion of the second ventilation channel and the casing portion that faces the leading end portion.

* * * * *